United States Patent [19]

Shimada et al.

[11] Patent Number: 4,917,176

[45] Date of Patent: Apr. 17, 1990

[54] DEVICE FOR CLEANING INNER SURFACES OF HEAT EXCHANGER TUBES

[75] Inventors: Toshimasa Shimada; Katsuhei Tanemura, both of Chofu; Yasuo Fujitani; Katsumoto Otake, both of Hitachi; Shigeo Oda; Yoshio Sumiya, both of Hitachi, all of Japan

[73] Assignees: Hitachi, Ltd.; The Tokyo Electric Power Co., Inc., both of Tokyo, Japan

[21] Appl. No.: 272,256

[22] Filed: Nov. 17, 1988

[30] Foreign Application Priority Data

Nov. 20, 1987 [JP] Japan ..... 62-292135

[51] Int. Cl.[4] ..... F28G 1/12; B08B 9/04

[52] U.S. Cl. ..... 165/95; 15/104.062

[58] Field of Search ..... 165/95; 15/104.062

[56] References Cited

U.S. PATENT DOCUMENTS 3,531,813 10/1970 Hurst ..... 15/104.062
4,467,488 8/1984 Creek ..... 15/104.062 X
4,627,486 12/1986 Baron ..... 165/95 X
4,716,611 1/1988 Barry ..... 15/104.062 X

*Primary Examiner*—Alan Cohan
*Attorney, Agent, or Firm*—Antonelli, Terry & Wands

[57] ABSTRACT

A device for cleaning inner surfaces of heat exchanger tubes including a pair of main cleaning device bodies each having a moving device and a brush driving device disposed on opposite tube plates on which each opened end of the heat exchanger tubes is disposed. At least one of the pair of main cleaning devices is provided with a cleaning brush changing device, and each brush driving devices is made to correspond to the opened end of the same heat exchanger tube so that pressurized fluid is alternately supplied to each of the corresponding brush driving device from a pressurized fluid supplying unit and thereby the cleaning brush is moved. As a result of this, only one cleaning brush can clean a multiplicity of heat exchanger tubes. Furthermore, since a brush changing device is provided, the cleaning brush can be at need replaced by fresh one so that a further number of heat exchanger tubes can be cleaned.

17 Claims, 7 Drawing Sheets

DEVICE FOR CLEANING INNER SURFACES OF HEAT EXCHANGER TUBES

BACKGROUND OF THE INVENTION

1. Industrial Field of the Invention

This invention relates to a device for cleaning inner surfaces of heat exchanger tubes, and, more particularly to a device capable of cleaning inner surfaces of heat exchanger tubes, this device being suitably used in a turbine condensers and of a type which drives a cleaning brush thereof which serves as a cleaning member by fluid force.

2. PRIOR ART

At present, cleaning of each of instruments of a plant is performed at regular intervals during the routine inspection of fossil power plants and nuclear power plants. However, many of cleaning works need to be manually performed and are dangerous or tedious works under rather severe conditions. Therefore, an improvement of it by automating the work is desired.

The major cleaning work of the type described above in turbine cycles comprises cleaning work of tubes in a condenser which serves as a heat exchanger. A variety of methods of automating this work have been disclosed.

For example, a method of cleaning the inner surfaces of such heat exchanger tubes is known in which a cleaning brush thereof is moved from one end portion of the tube to the other end portion of the same by pressurized fluid supplied from an injection nozzle of a brush driving device. As a result of this, the inner surfaces of each of the tubes are successively and automatically cleaned by the cleaning brush (See Japanese Patent Unexamined Publication No. 61-72997 and Japanese Patent Unexamined Publication No. 61-205797).

Another example is known which is so constituted that a holding device in which a cleaning brush is disposed is respectively mounted on a space at each end of a plurality of heat exchanger tubes so that one or a plurality of these cleaning brushes are moved by pressurized fluid supplied by a driving device from one end portion of the tube to the other end portion of the same. Furthermore, the thus moved cleaning brushes are returned by the normal currents in the condenser or the same are reciprocated by supplying pressurized fluid in the reverse direction by way of turning the switch valve therein. As a result of this, one or a plurality of heat exchanger tubes are simultaneously cleaned (See Japanese Patent Unexamined Publication No. 55-8593 and Japanese Patent Unexamined Publication No. 60-38594).

However, if the inner surfaces of the heat exchanger tubes are cleaned in the former type of method, a great number of cleaning brushes, which are to be moved from one end portions of the tubes to the other end portions of the same by pressurized fluid, needs to be provided since a usual condenser includes approximately ten thousand of such heat exchanger tubes. Therefore, a particular method is required to automatically supply such cleaning brushes. Furthermore, large labor and excessive long time need to be taken to recover the large number of cleaning brushes after they have been used.

In a case where the latter method is employed, the cleaning brushes and the holding devices need to be provided by the number capable of cleaning the above-described large number of the heat exchanger tubes.

Furthermore, the judging of the extent of wear of the cleaning brushes is difficult to be performed and exchange of the same cannot be carried out easily.

An object of the present invention is to provide a device for cleaning inner surfaces of heat exchanger tubes and which is capable of cleaning a multiplicity of heat exchanger tubes by a cleaning brush which is arranged to be moved in the heat exchanger tubes by pressurized fluid.

Another object of the present invention is to provide a device for cleaning inner surfaces of heat exchanger tubes and enabling readily changing cleaning brushes which are worn due to cleaning the inner surfaces of the heat exchanger tubes.

A further object of the present invention is to provide a device for cleaning inner surfaces of heat exchanger tubes and enabling determining the extent of wear of cleaning brushes which move in the heat exchanger tubes and the clogging conditions in the tubes.

SUMMARY OF THE INVENTION

According to the present invention a device for cleaning inner surfaces of heat exchanger tubes is provided, this device comprising:

a pair of main cleaning device bodies each having a moving device and a brush driving device and disposed on opposite tube plates in which ends of heat exchange tubes are respectively opened;

a brush changing device provided for at least one of the pair of main cleaning device bodies, each of said brush driving devices being disposed corresponding to the opened end of the same heat exchanger tube; and a pressurized fluid supplying unit for moving a cleaning brush by supplying a pressurized fluid to each of brush driving devices.

According to the present invention, the brush driving device is provided with a driving nozzle, a part of which is inserted into the heat exchanger tube, and brush state judging means.

As described above, since the main cleaning device bodies are respectively provided on the tube plates disposed at two ends of the heat exchanger tubes and the cleaning brush is moved by supplying the pressurized fluid to each of the brush driving devices corresponding to the opened ends of the same heat exchanger tube, only one cleaning brush can clean a multiplicity of heat exchanger tubes. Furthermore, since a brush changing device is provided, cleaning brush can be at need changed. As a result of this, a further great number of heat exchanger tubes can be cleaned.

Furthermore, the brush state judging means provided at a part portion of the brush driving device will provide proper judge upon the abnormality of the heat exchanger tubes and the cleaning brush.

DESCRIPTION OF THE PREFERRED EMBODIMENT

A device for cleaning inner surfaces of heat exchanger tubes according to an embodiment of the present invention will now be described with reference to FIGS. 1 to 9.

Figure 1:
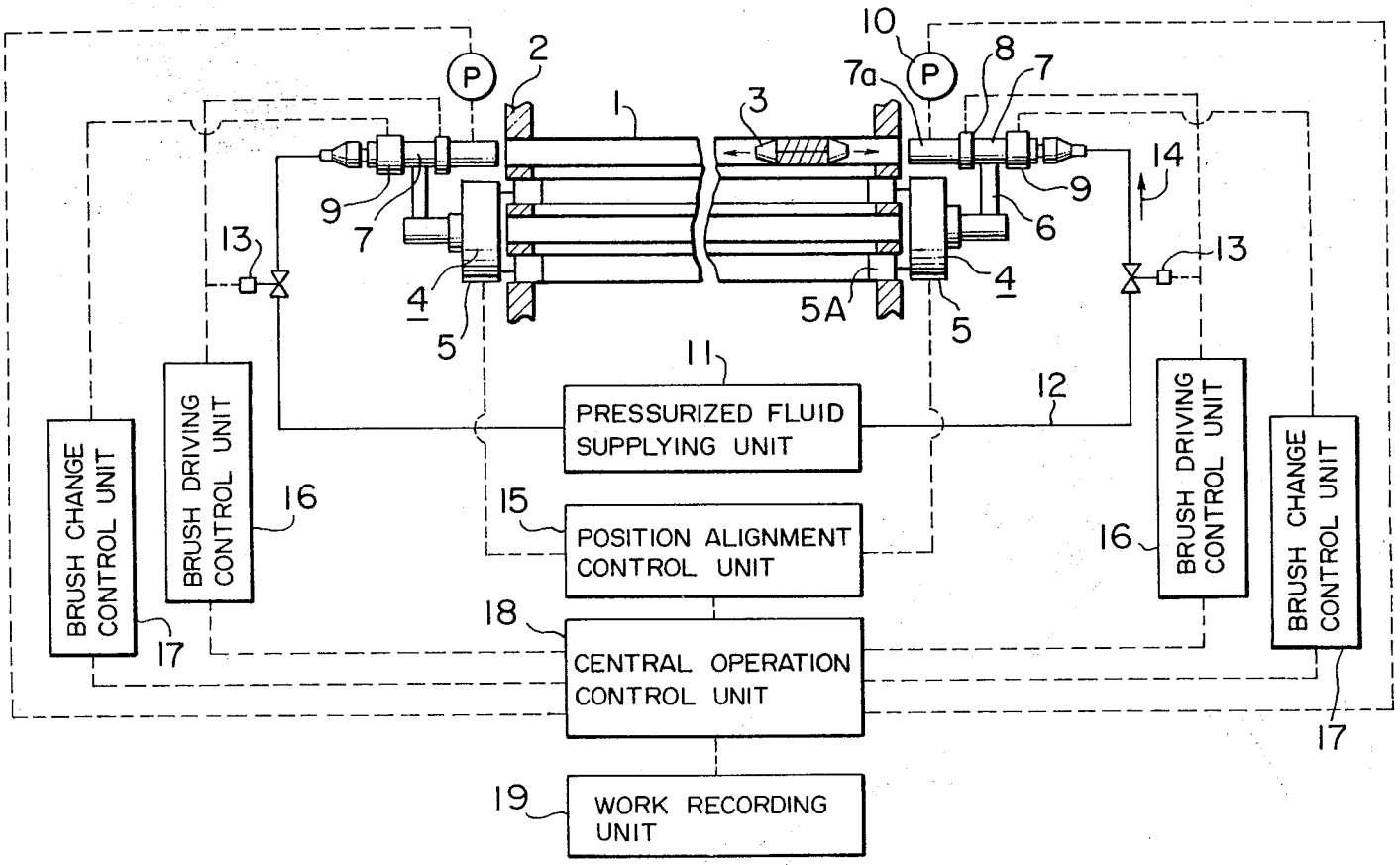
FIG. 1 is a schematic view of a device for cleaning inner surfaces of heat exchanger tubes according to an embodiment of the present invention.

FIG. 1 illustrating the device for cleaning inner surfaces of heat exchanger tubes according to the present invention is a schematic view in which a part of the heat exchanger is illustrated simply. The two end portions of a plurality of heat exchanger tubes 1 are secured to tube plates 2 in the known manner. In order to effectively clear each inner surface of multiplicity of heat exchanger tubes 1 by a cleaning brush 3 which is arranged to be moved by pressurized fluid which comprises, for example, water or air, main cleaning device bodies 4 are disposed on the two tube plates 2. Each of the two main cleaning device bodies 4 comprises: in the illustrated case, a moving device 5 having a leg portion 5A which repeatedly performs insertion and withdrawal to and from the heat exchanger tubes 1; and a brush driving device 7 disposed at each of the open end portions of the heat exchanger tubes 1 to be cleared. Each brush driving devices 7 is formed in such a manner that it can be contracted and rotated, and is secured to the main cleaning device body 4 by an arm 6. If necessary, two or more brush driving devices 7 may be supported on the main cleaning device body 4.

Therefore, the cleaning brush 3 cleans the inner surfaces of the tubes in such a manner that it reciprocates within the tube in the direction designated by an arrow shown in FIG. 1 from right to left by the brush driving devices 7 which are disposed at the opposite end portions of the heat exchanger tubes 1 in an opposed manner to each other.

Each of the brush driving devices 7 supported by the arm 6 comprises, in this embodiment, a device 8 on to which a shock damper is mounted for the purpose of damping the shock due to receipt of the cleaning brush 3 which is being moved from one side 7*a* by the brush driving nozzle 7*a* which opposes the heat exchanger pipe 1 to be cleaned; a brush changing device 9 for use when brushes are worn or lost or for use in successively changing the cleaning brushes at the time of performing cleaning; and a brush state judging means 10 such as a pressure detecting device for observing the state of the cleaning work or judging the state of the cleaning brushes 3. The pressurized fluid required to drive the cleaning brushes 3 is, for example, supplied to the brush driving mechanism 7 in the direction, for example, designated by an arrow 14 in response to a command signal from a pressurized fluid supplying unit 11 which actuates a pressurized fluid supplying line 12 for operating a control valve 13 such as an electrically operated valve or an electromagnetic valve. In this embodiment, the moving device 5 and the arm 6 of the main cleaning device body 4 disposed on the surface of the tube plate 2 are operated in response to a command signal supplied from a moving position control unit 15. A control valve 13 at the intermediate portion of the pressurized fluid supplying line 12 connected to the device 8 on to which the shock damper is mounted is controlled by a command signal supplied from a brush driving control unit 16. The brush changing device 9 is controlled by an a command signal from a brush change control unit 17. A central operation control unit 18, depending upon a predetermined program or a signal from the brush state judging means 10, controls collectively the above-described control units 15, 16, and 17. Furthermore, it comprises the most significant unit capable of supplying and receiving signals and having a work recording unit 18 for recording the work state of each of the heat exchanger tubes 1.

The central operation control unit 18 may be, at need, individually manufactured or a part or overall body of the same way be integrally formed.

Figure 2:
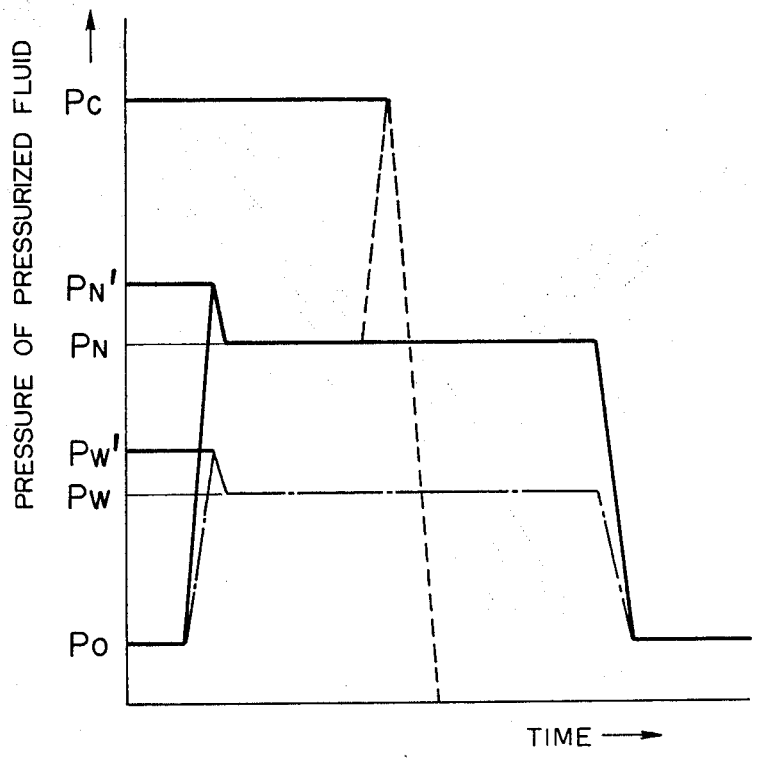
FIG. 2 is a graph illustrating the relationship between pressure of pressure feed fluid and time.

As the brush state judging means 10, a pressure detecting device which merely detects the pressure or a measuring instrument capable of estimating the state of the cleaning brush 3 by measuring the number of the movements of the cleaning brush 3 by the pressurized fluid in the heat exchanger tubes 1 may be employed. When the pressure detecting device is used, pressure observation when the cleaning brush 3 is moved through the heat exchanger tubes 21 by the pressurized fluid is performed by the brush driving portion so that the abnormal state of the wear of the cleaning brush 3 or the clogging state in the heat exchanger tubes 1 can be judged. That is, when the cleaning brush 3 is moved through the heat exchanger tube 1 by pressurized fluid, the pressure of the fluid at the normal cleaning state is, as shown in FIG. 2, changed in such a manner that the initial pressure Po, as designated by a continuous line, temporarily rises up to pressure $P_N'$ which corresponds to a static friction. Then it is lowered to pressure $P_N$ which corresponds to a dynamic friction when a certain time lapse is taken. Finally, after the cleaning work has been completed, the pressure becomes Po which is the same level at the start of the cleaning work. However, even if any clogging is generated in the heat exchanger tube 1, the pressure rapidly rises, during the cleaning work, up to the level which excessively exceeds the reference level as designated by the dashed line. It does not rise infinitely, and when the pressure becomes Pc, it is made zero due to separation or damage of the parts in the main cleaning device body 4, for example, the moving device 5. As a result of this, the cleaning work is completed with the abnormality remained. Furthermore, if the cleaning brush 3 is worn, the pressure is at Pw' which is, as shown by an alternate long and short dash line below the reference level, and does not rise to $P_N$. The pressure feed is made easier by the wear, and the cleaning work is completed with the abnormality remained. As described above, the work state can be easily acknowledged by measuring and observing the pressure of the pressurized fluid 14 so that the falling-off or the like of the moving device can be prevented. Furthermore, when any clogging is found in the heat exchanger tube 1 or when the cleaning brush 3 is worn, it can be used as a signal for instructing to change the cleaning brush 3.

Figure 4:
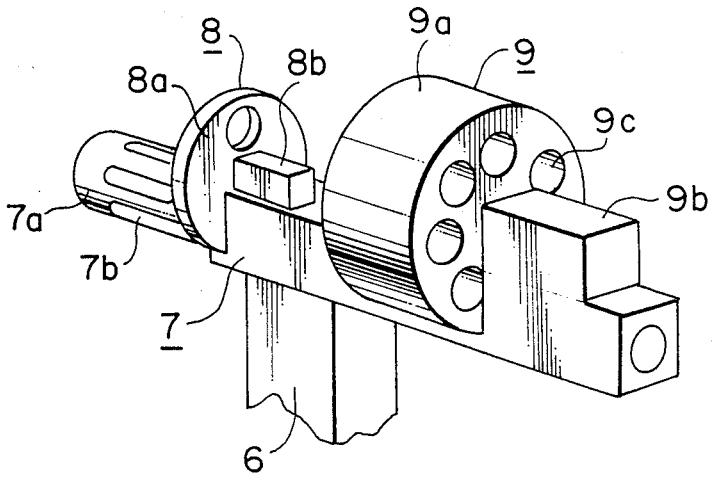
FIG. 4 is a perspective view illustrating the brush driving device shown in FIG. 1

FIG. 4 illustrates an example of the brush driving device 7 according to the present invention shown in FIG. 1. The brush driving device 7 comprises, at the front end portion thereof, a brush driving nozzle 7*a* supported by the arm 6. A device 8 on to which the shock damper is mounted and having a fastening plate 8*a* and a device 8*b* for driving the device 8 on to which the shock damper is mounted is disposed between the brush driving device 7 and the brush driving nozzle 7*a*. The rear portion of the brush driving device 7 is constituted by a brush storing device 9*a* in which a plurality of storing portions 9*c* are formed and a brush changing device 9 having a mechanism 9*b* for driving the changing device. At the front end portion of the brush driving nozzle 7*a* is provided, for example, slits 7*b* for discharging deposit or pressurized fluid injected from the heat exchanger tubes 1 when the cleaning brush 3 is received.

Figure 5A:
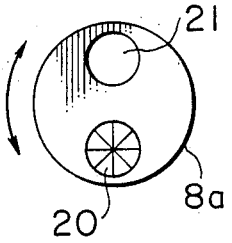
FIG. 5A is a side-elevational view illustrating a shock damper member used in the device shown in FIG. 4.

A plate 8*a* on to which the shock damper device 8 is mounted is, as shown in FIG. 5A, designed in the form of a disk. A guide hole 21 through which the cleaning brush 3 can be passed is disposed on one side of the disk, while another side thereof is provided with a shock damper 20 made of a thin film with, for example, slits. This plate 8*a* on to which the shock damper device 8 is mounted is rotated by the mechanism 8*b* for driving the device on to which the shock damper is mounted in the direction as designated by an arrow so that the retracting and mounting of the shock damper 20 and the guide hole 21 are performed in the manner as described later. As the plate 8*a* on to which the shock damper device 8 is mounted, a rectangular shaped one can be employed so as to be reciprocated as an alternative to the illustrated rotation method.

Figure 5B:
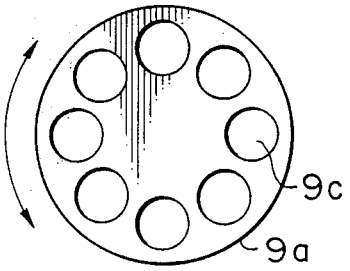
FIG. 5B is a side-elevational view illustrating a brush changing device used in the device shown in FIG. 4.

The brush storing device 9*a* of the brush changing device 9 is designed, as shown in FIG. 5B, in such a manner that it is shaped cylindrically and having a plurality of storing portions 9*c* so that fresh cleaning brushes and worn brushes are stored in each of the storing portions 9*c*. As a result of its rotation by the mechanism 9*b* for driving the changing device in the direction as designated by an arrow, supply and change of the cleaning brushes can be performed. Although the brush storing device 9*a* is, in this embodiment, shaped cylindrically so as to provide a great many storing portions 9*c*, it is not limited to this. For example, it can be formed so as to have a cross-sectional sector shape. Furthermore, it may be disposed behind the driving nozzle 7*a* of the brush driving device 7 as an alternative to the illustrated rear position.

Figure 3:
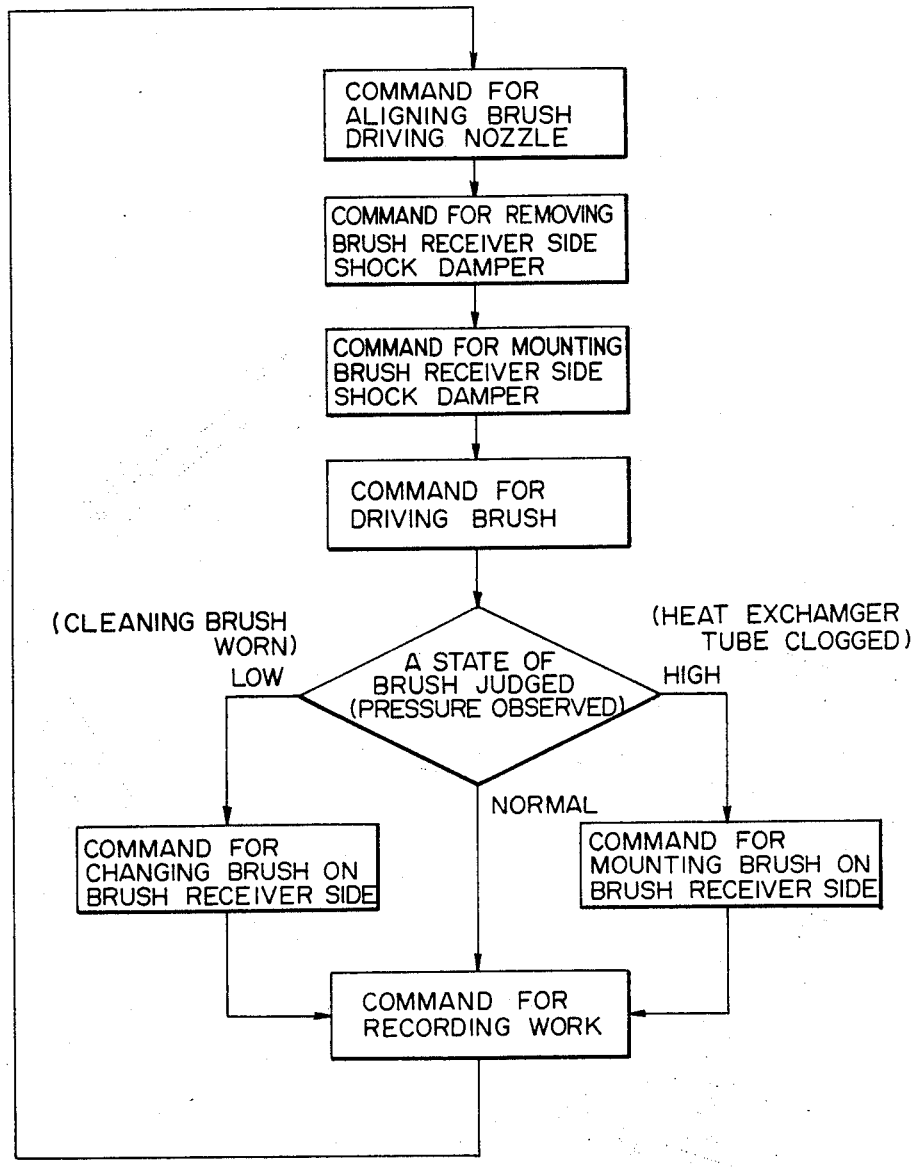
FIG. 3 is a block diagram illustrating an example of an operation control flow when cleaning work is performed by the device shown in FIG. 1.

In the embodiment shown in FIG. 1, when the inner surfaces of the heat exchanger tubes 1 are cleaned, it is performed in accordance with, for example, an operation control flow shown in FIG. 3 set in the central operation control unit 18. Each portion is operated in response to command signals which are successively supplied. Next, it will now be successively described in accordance with the operation control flow set in the central operation control unit 18.

(a) Command for aligning the position of the brush driving nozzle

A signal is supplied to the main cleaning device bodies 4 disposed at the opposite end portions so as to operate the moving device 5 and the arm 6. As a result of this, the brush driving nozzle 7*a* at the front end portion of the brush driving device 9 is aligned at the position of the opening at the end portion of the heat exchanger tube 1.

(b) Command for retracting the shock damper from the brush driving side

Since the shock damper is needless on the cleaning brush driving side, a signal is supplied to the shock damper mounting device 8 via the brush driving control unit 16 so as to operate it. As a result of this, the shock damper is removed.

(c) Command for mounting the shock damper on the brush receiving side

On the side for receiving the cleaning brush 3 which has been moved through the heat exchanger tube 1, a signal is supplied to the shock damper mounting device 8 via the brush driving control unit 16 so as to operate it. As a result of this, the shock damper is mounted.

(d) Command for driving brush

In response to the commands shown in (a) to (c), the preparation for driving the cleaning brush 3 to the heat exchanger tubes 1 to be cleaned by the two main cleaning device bodies 4 is achieved. The control valve 13 disposed in the pressurized fluid supplying line 12 on the brush driving side is opened by the signal supplied from the brush driving control unit 16 so that the pressurized fluid 14 is supplied from the pressurized fluid supplying unit 11 to the brush driving device 7. As a result of this, the cleaning brush 3 is driven.

(e) Judging of the state of the brush (Observation of the pressure)

In this case, since the pressure observation device is used as the brush state judging means 10, the pressure of the pressurized fluid 14 is always observed and its work state can be monitored during the brush driving work. In this case, assuming that the pressure of the heat exchanger tube to be judged is P, the optional high pressure which is set is Pu, while the low high pressure which is set is Pd, the following judge is made by making comparison between the above factors:

$Pu < P$ . . . clogging in the heat exchanger tube, cleaning brush is retained $Pd < P < Pu$ . . . cleaning brush is normal $P < Pd$ . . . cleaning brush is worn The level of each of the pressures Pu and Pd is, for example, determined between the pressures $P_N$ and $P_W$ considering the pressure $P_N$ shown in FIG. 2.

In this determination, if the pressure at the inside portion of the heat exchanger tube becomes high, a signal to stop supply of the pressurized fluid 14 is immediately supplied from the central operation control unit 18 for the purpose of preventing damages or falling-off of the main cleaning device body 4. Furthermore, since this cleaning brush 3 is lost, the brush changing device 9 is operated so as to mount a novel cleaning brush 3 on the brush receiving side (next brush driving side) to which signals are supplied from the control units 18 and 17 for preparation of the next cleaning work for the heat exchanger tubes.

If it is judged that the pressure at the inside portion of the heat exchanger tube has become low, it shows the state where the cleaning brush 3 has been worn. Therefore, a signal is, similarly to the above description, supplied from each of the units 18 and 17 for the preparation for the next cleaning work for the heat exchanger tube, so as to operate the brush changing device 9 at the brush receiving side. As a result of this, the worn brush is replaced by a fresh one.

(f) Command for recording the work

The result of the abnormal state, a state where the cleaning brush is changed or the normal completion is recorded in the work recording unit 19.

The cleaning of a multiplicity of the heat exchanger tubes 1 of the heat exchanger is thus completed by way of moving the cleaning brush 3 with the pressurized fluid by repetitions of the above-described operations.

During the above-described cleaning work, if any clogging is found in a heat exchanger tube 1, a closing plug is driven into the opening of this heat exchanger tube 1 or it is closed by a man power at the time of the cleaning work or in accordance with the contents written on the work record after the cleaning work has been completed.

Figure 6A:
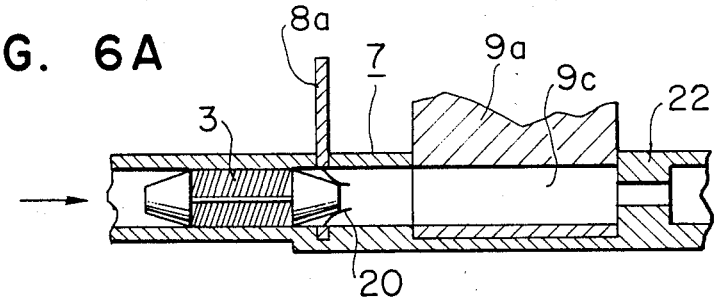
FIGS. 6A and 6B are cross-sectional views each illustrating the state where the cleaning brush is moved when the cleaning work is performed.
Figure 6B:
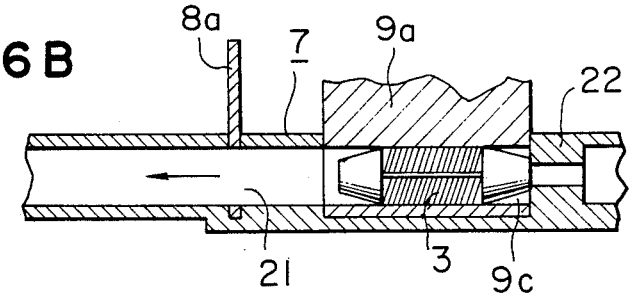

FIGS. 6A and 6B show the state where the plate 8*a*, on which the shock damper is mounted, provided in the brush driving device 7 is operated in a case where the two main cleaning device bodies 4 of the same structure are disposed, as shown in FIG. 1, in a manner opposed to each other, and when a signal is each supplied from the central operation control unit 18 to the brush driving control unit 16 and the brush change control unit 17 so as to move the cleaning brush 3 through the heat exchanger tube 1. When the brush 3 is received, the plate 8*a* on which the shock damper is mounted is rotated so as to mount the shock damper 20 as shown in FIG. 6A. As a result of this, the shock due to the arrival of the cleaning brush 3 can be absorbed. Finally, it can be stopped at a predetermined position by way of crushing to a stopper formed by reducing the inner diameter of the pressurized fluid supplying line or by way of being received by a choked portion or a stopper formed in a part portion of each of the storing portions 9*c* of the brush storing device 9*a*. In a case where the cleaning brush 3 has been worn, it can be replaced by the rotation of the brush storing device 9*a*, but the process is usually shifted to a driving mode as it is. When the brush is driven, it is disposed on the side of the guide hole 21 by the rotation of the plate 8*a* on which the shock damper is mounted by the operation of the shock damper device so that the cleaning brush 3 can be, without any trouble, driven into the heat exchanger tube 1.

As described above, since a pair of the main cleaning device bodies are disposed in a manner opposing to each other so as to be used to clear the heat exchanger tubes of a heat exchanger, only one cleaning brush can clean a multiplicity of the heat exchanger tubes. Furthermore, since the brush changing device comprising a brush storing device capable of storing a multiplicity of cleaning brushes is provided, the cleaning brush can be replaced at need at the cleaning work. As a result of this, the cleaning work can be effectively performed. Furthermore, since a part of the brush driving device is provided with the brush state judging means for judging the state of the brush, the judging of the clogging state in the heat exchanger tubes and the judging of the state of the wear of the cleaning brush can be performed. As a result of this, a significant effect can be obtained.

As an alternative to reciprocating the same cleaning brush in a case where a pair of the main cleaning device bodies 4 of the same shape are used in a manner opposing to each other, another way may be employed in which a multiplicity of fresh cleaning brushes 3 are stored in the brush storing device for one side brush changing device 9 and the other side brush storing device is made empty at the cleaning work.

That is, another structure may be employed in which, by moving the cleaning brush 3 with pressurized fluid through the heat exchanger tube 1 from one side brush driving device 7 which is set by a command supplied from the central operation control unit 18 so as to be stored by the other side. Then, the both brush storing devices or the like are driven so as to alternately perform the cleaning of the different heat exchanger tubes, and all of the brushes are moved to the other side. Next, the other side brush driving device is actuated by a command from the central operation control unit 18 so as to repeat the similar operation. In this case, although the number of cleaning brushes are determined in accordance with the number of the storing portions arranged for the brush storing device, the control system of all of the control units including the central operation control unit 18 can be simplified.

When the cleaning work of each of the heat exchanger tubes 1 is performed in such a manner that the two brush storing devices of the brush changing device 9 of the two main cleaning device bodies 4 accommodate the cleaning brushes 3 respectively, at least of the one side brush storing portion of the one side brush storing device needs to be made empty before starting a predetermined cleaning work. In this case, a structure may be employed in which the brush storing device which becomes the brush receiving side corresponding to the brush driving side is made empty so as to receive the coming cleaning brush 3. Furthermore, in accordance with a predetermined program which is set in the central operation control unit 18, the same cleaning brush 3 is moved through the same heat exchanger tube by the brush driving device 7 or the same is moved through the heat exchanger tube so as to be returned. Another system may be employed in which the following operation is repeated: the brush changing device 9 is operated after the brush has been received, and another cleaning brush 3 is moved toward the empty storing portion of the brush changing device of the main cleaning device body which has been first operated. In the above-described system in which the two of the brush storing devices are activated, since a multiplicity of cleaning brushes are included in this system, significantly great number of heat exchanger tubes can be effectively cleaned in accordance with the procedure predetermined in the central operation control unit when the thus-disposed two main cleaning device bodies 4 are once operated. As a result of this, an effect can be obtained that times of suspension of operation caused when the cleaning brushes are replaced are reduced.

Figure 7:
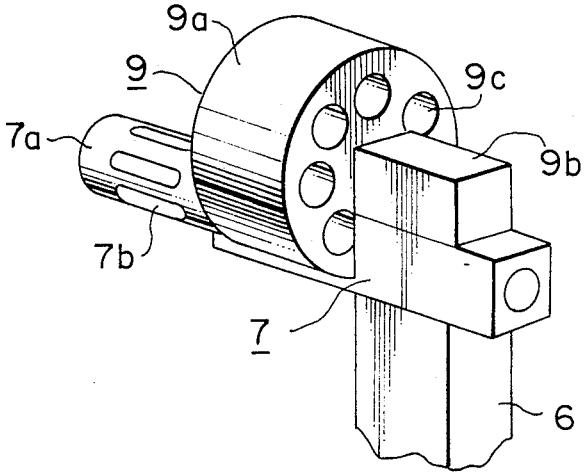
FIG. 7 is a perspective view illustrating another embodiment of the brush driving device.
Figure 8:
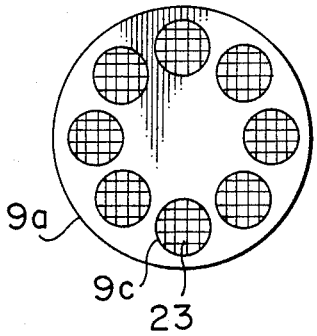
FIG. 8 is a perspective view illustrating a brush changing device used in the device shown in FIG. 7.
Figure 9:
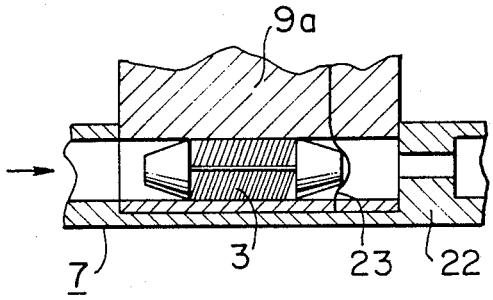
FIG. 9 is a cross-sectional view illustrating an essential portion of the device shown in FIG. 7.

A brush driving device 7 according to the other embodiment of the present invention is shown in FIGS. 7 to 9. The difference of this embodiment from the embodiment shown in FIGS. 4, 5A, and 5B lies in that the shock damper is assembled within the brush changing device 9 for the purpose of realizing a compact system. That is, as can be clearly seen from FIGS. 8 and 9 in which the brush storing device 9*a* is illustrated, a mesh shock dampers 23 made of, for example, a contractive material, are respectively fastened by way of, for example, being sandwiched by members which are divided into two pieces. As a result of this, when the brush which has been moved to the brush changing device 9*a* of the brush driving device 7 through the heat exchanger tube is received, the shock due to the cleaning brush 3 is absorbed and thereby stopped b the mesh shock damper 23 exhibiting contractility. Or it is moved further until it strikes the stopper 22 so that the cleaning brush 3 is stopped in the brush storing device. Since the shock damper 23 according to this embodiment is designed to be in the form of a mesh and it thereby does not prevent the flow of the pressurized fluid, the shock damper 23 does not need to be removed in the next driving mode. As a result of this, the cleaning brush 3 can be effectively driven.

Figure 10:
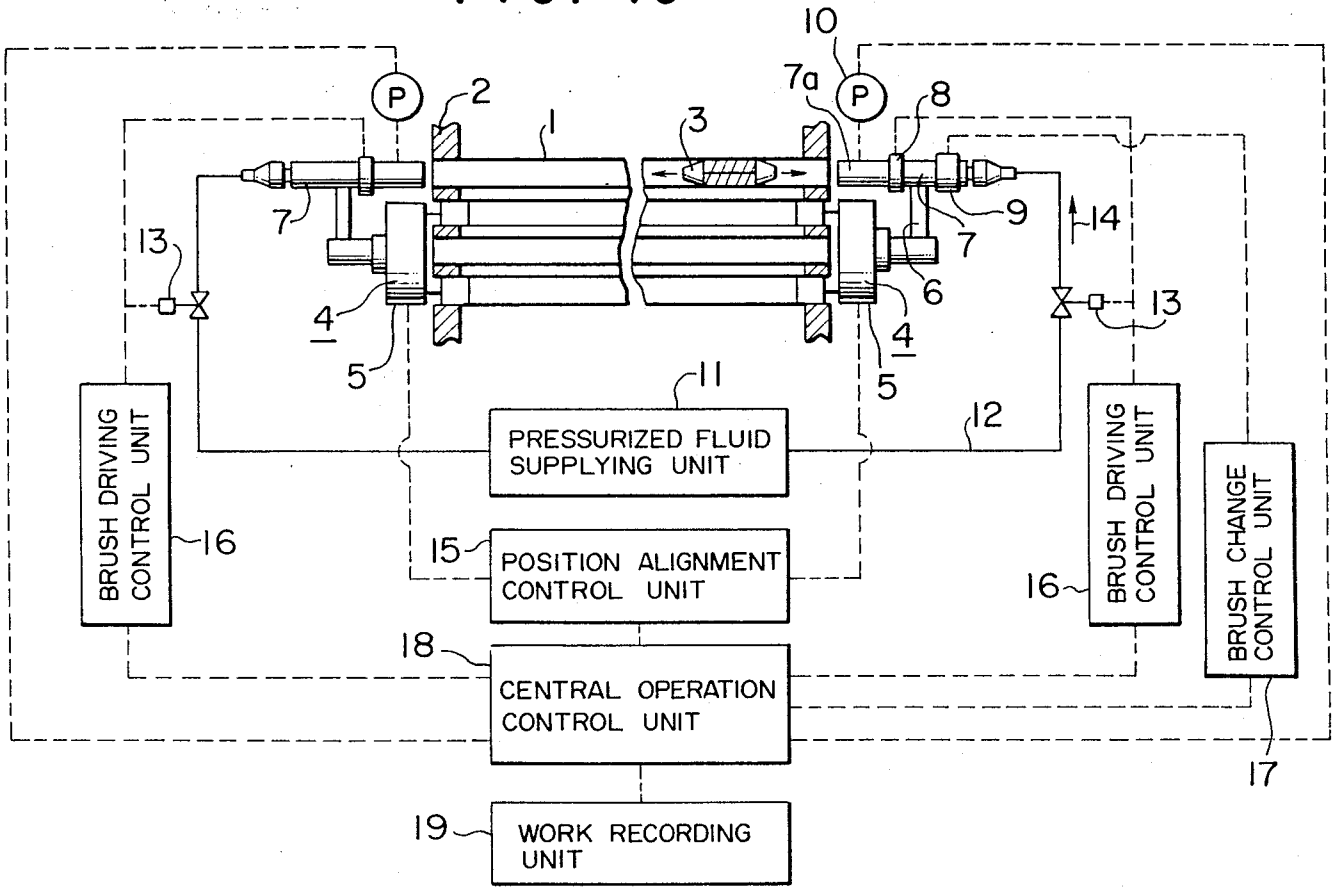
FIG. 10 is a schematic view illustrating a device for cleaning the inner surfaces of the heat exchanger tubes according to another embodiment of the present invention.

The overall structure of a device for cleaning the inner surface of the heat exchanger tubes according to another embodiment of the present invention is shown in FIG. 10. The difference of the overall structure according to this embodiment from that shown in FIG. 1 lies in that the brush driving device 7 of the left main cleaning device body 4 of the two main cleaning device bodies 4 and 4 each of which are transversely opposed to each other is not provided with the brush changing device. Other structure is quite the same as each other. The cleaning work for the heat exchanger tubes performed by the device according to this embodiment will be simply described. The work performed in accordance with a command supplied from the central operation control unit 18 is as follows:

(a) The cleaning brush 3 disposed within the brush changing device 9 is driven by the brush driving device 7 of the right main cleaning device body 4.

(b) Since the left main cleaning device body 4 is not provided with any brush changing device, the cleaning brush 3 is directly received by the brush driving device 7. Next, the cleaning brush 3 is merely driven in the same heat exchanger tube 1 or other heat exchanger tube so as to move it to the opposite side main cleaning device body 4. Next, the cleaning brush 4 is stored by the brush changing device.

(c) The right cleaning device body 4 having the brush driving device 7 receives the cleaning brush 3 which has been returned from the left cleaning device body 4. It performs change of the cleaning brush 3, if necessary, in accordance with the result of the brush state judging means 10 which comprises, for example, a pressure detecting device or a counter, and then it continues the cleaning work.

That is, the cleaning brush 3 can be always performed by one main cleaning device body 4 with the device according to this embodiment.

Figure 11:
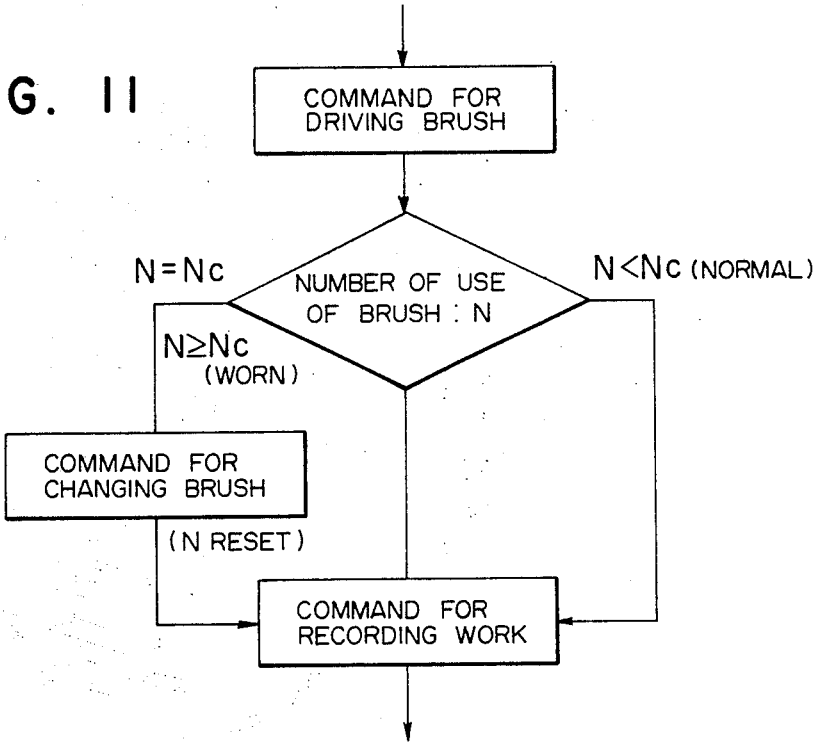
FIG. 11 is a block diagram illustrating another example of the control flow for the judging of the need of change of the cleaning brush.

According to this embodiment, since the structure of one main cleaning device body is designed to be a structure from which the brush changing device is omitted, the structure and the control system of one side portion of the device can be simplified. However, substantially the similar effect of the cleaning work can be obtained. Another judging flow used for realizing brush change is shown in FIG. 11. The difference from the above-described embodiment lies in that the number of use of the cleaning brush is used as the criterion for the judging of the brush change by the brush state judging means as an alternative to the pressure serving as this criterion. That is, as shown in FIG. 11, the number of use of the brush is calculated in the central operation control unit by a counter when the brush driving is instructed. If the thus-calculated number N and the reference number Nc for changing the brush becomes $N \geqq Nc$, which shows the same meaning as that the brush has been worn, a command for changing the brush is supplied so that the cleaning brush is automatically changed (simultaneously the number of use of it is reset to zero). Therefore, the structure of the pressure detecting device can be significantly simply constituted since the only needed pressure to be detected at the time of driving the cleaning brush is the high pressure Pc which appears when the heat exchanger tube is clogged.

EFFECT OF THE INVENTION

As a result of constituting the structure of the device for cleaning the inner surfaces of heat exchanger tubes according to the present invention in which the heat exchanger tubes are respectively disposed on the corresponding two end portions of the heat exchanger tube, only one cleaning brush can clean a multiplicity of heat exchanger tubes. Furthermore, since the brush changing device storing a multiplicity of cleaning brushes is provided, the heat exchanger tubes can be effectively cleaned by properly operating the brush changing device. In addition, since the cleaning work is performed by one central operation unit which collectively controls the two main cleaning bodies, automating the cleaning work for the heat exchanger tubes can be significantly progressed.

We claim:

1. A device for cleaning inner surfaces of heat exchanger tubes constituted in such a manner that opposite opened ends of a plurality of said heat exchanger tubes are secured to corresponding tube plates, brush driving devices supported by main cleaning device bodies having moving devices are made to confront said opened ends of said heat exchanger tubes, and cleaning brushes are moved by pressurized fluid supplied to said brush driving devices so that the inner surfaces of said heat exchanger tubes are cleaned, said device for cleaning inner surfaces of heat exchanger tubes comprising:

a pair of said main cleaning device bodies each having said moving device and said brush driving device an disposed on said tube plates in which said ends of said heat exchanger tubes are respectively opened;

a brush changing device provided for at least one of said pair of main cleaning device bodies, each of said brush driving devices being disposed corresponding to said opened end of the same heat exchanger tube; and a pressurized fluid supplying unit for moving said cleaning brush by supplying said pressurized fluid to each of said brush driving devices.

2. A device for cleaning inner surfaces of heat exchanger tubes according to claim 1, wherein said brush changing device is disposed behind said brush driving device, and is constituted by at least of a brush storing device in which a plurality of portions for storing said cleaning brushes and a changing mechanism.

3. A device for cleaning inner surfaces of heat exchanger tubes according to claim 1, wherein said brush storing device is designed to be in the form of a rotatable cylindrical shape.

4. A device for cleaning inner surfaces of heat exchanger tubes according to claim 1, wherein said brush driving device is provided with a driving nozzle, a part of which is inserted into said heat exchanger tube and brush state judging means.

5. A device for cleaning inner surfaces of heat exchanger tubes according to claim 1, wherein said brush state judging means comprises a pressure detecting device.

6. A device for cleaning inner surfaces of heat exchanger tubes according to claim 1, wherein members for damping the shock due to said cleaning brush are provided for at least one of said brush driving device and said brush changing device.

7. A device for cleaning inner surfaces of heat exchanger tubes according to claim 1, wherein each of said brush driving devices is connected to said pressurized fluid supplying unit through pressurized fluid supplying lines, in each of which a control valve for switching supply of said pressurized fluid is disposed.

8. A device for cleaning inner surfaces of heat exchanger tubes constituted in such a manner that opposite opened ends of a plurality of said heat exchanger tubes are secured to the corresponding tube plates, brush driving devices supported by main cleaning device bodies having moving devices are made to confront said opened ends of said heat exchanger tubes, cleaning brushes are moved by pressurized fluid supplied to said brush driving devices so that the inner surfaces of the heat exchanger tubes are cleaned, said device for cleaning inner surfaces of heat exchanger tubes comprising:

a pair of said main cleaning device bodies each having said moving device and said brush driving device and disposed on said opposite tube plates in which said ends o said heat exchange tubes are respectively opened;

brush changing devices which are respectively provided on said main cleaning device bodies, said brush changing device being constituted by a brush storing device in which a plurality of portions for storing said cleaning brushes are provided and a changing mechanism, wherein each of said brush driving devices is made to correspond said opened end of the same heat exchanger tube, whereby, by moving said cleaning brush supplied from said storing portion of said brush changing device of one side one of said main cleaning device bodies by supplying said pressurized fluid to said brush driving device from said pressurized fluid supplying unit, a repeated operation that all of the cleaning brushes moved through individual tubes are successively stored in each of empty storing portions of said brush storing device of the other one of said main cleaning bodies can be performed by switching the pressurized fluid supply from said pressurized fluid supplying unit to the other side one of said main cleaning device bodies.

9. A device for cleaning inner surfaces of heat exchanger tubes according to claim 8, wherein said brush driving device comprises a driving nozzle a part of which is inserted into said heat exchanger tube and brush state judging means.

10. A device for cleaning inner surfaces of heat exchanger tubes according to claim 8, wherein a shock damper member is provided for either said brush driving device or said brush changing device.

11. A device for cleaning inner surfaces of heat exchanger tubes constituted in such a manner that opposite opened ends of a plurality of said heat exchange tubes are secured to the corresponding tube plates, brush driving devices supported by main cleaning device bodies having moving devices are made to confront said opened ends of said heat exchanger tubes, cleaning brushes are moved by pressurized fluid supplied to said brush driving devices so that the inner surfaces of the heat exchanger tubes are cleaned, said device for cleaning inner surfaces of heat exchanger tubes comprising:

a pair of said main cleaning device bodies each having said moving device and said brush driving device and disposed on said opposite tube plates in which said ends of said heat exchange tubes are respectively opened;

brush changing devices which are respectively provided for said main cleaning device bodies, said brush changing device being constituted by a brush storing device in which a plurality of portions for storing said cleaning brushes are provided and a changing mechanism, wherein each of said brush driving devices is made to correspond to said opened end of the same heat exchanger tube, whereby, by moving said cleaning brush supplied from said storing portion of said brush changing device of one side one of said main cleaning device bodies by supplying said pressurized fluid to said brush driving device from said pressurized fluid supplying unit, said cleaning brushes are stored in each of empty storing portions of said brush storing device of the other side one of said main cleaning bodies, and by switching the pressurized fluid supply from said pressurized fluid supplying unit to the other side one of said main cleaning device bodies and by operating said brush storing device, the supply of other cleaning brush can be supplied so that said other cleaning brushes can be successively moved through said heat exchanger tube.

12. A device for cleaning inner surfaces of heat exchanger tubes according to claim 11, wherein each of said brush driving devices corresponding to said brush portions is provided with a driving nozzle, a part of which is inserted into said heat exchanger tube and a brush state judging means, each of the opposing brush driving devices is provided with another driving nozzle, a part of which is inserted into said heat exchanger tube and another brush judging means, each of said brush driving devices is connected to s id pressurized fluid supplying unit having pressurized fluid supplying lines, in each of which a control valve for use in switching is disposed and capable of moving said cleaning brush by supplying pressurized fluid, and a shock damper member is provided for either said brush driving device or said brush changing device.

13. A device for cleaning inner surfaces of heat exchanger tubes according to claim 11, wherein a member for damping the shock caused by said cleaning brush is provided on either said brush driving device or said brush changing device.

14. A device for cleaning inner surfaces of heat exchanger tubes constituted in such a manner that opposite opened ends of a plurality of said heat exchanger tubes are secured to the corresponding tube plates, brush driving devices supported by main cleaning device bodies having moving devices are made to confront said opened ends of said heat exchanger tubes, and cleaning brushes are moved by pressurized fluid supplied to said brush driving devices so that the inner surfaces of said heat exchanger tubes are cleaned, said device for cleaning inner surfaces of heat exchanger tubes comprising:

a pair of said main cleaning device bodies each having said moving device and said brush driving device and disposed on said tube plates in which said ends of said heat exchanger tubes are respectively opened;

brush changing devices each provided on said main cleaning bodies and constituted by a brush storing device in which a plurality of portions for storing said cleaning brushes are provided and a changing mechanism;

each of said brush driving devices corresponding to said opened ends of the same heat exchanger tube and provided with a driving nozzle, a part of which is inserted into said heat exchanger tube and brush state judging means;

each of the corresponding brush driving devices provided with a driving nozzle, a part of which is inserted into said heat exchanger tube and brush state judging means, wherein said brush driving devices are respectively connected to a pressurizing fluid supplying unit having a pressurized fluid supplying lines, in each of which a control switch valve for moving said cleaning brush by supplying said pressurized fluid is provided; and members for damping the shock caused by said cleaning brush and provided for either said brush driving device or said brush changing device.

15. A device for cleaning inner surfaces of heat exchanger tubes according to claim 14, wherein said brush state judging means comprises a pressure detecting device.

16. A device for cleaning inner surfaces of heat exchanger tubes constituted in such a manner that opposite opened ends of a plurality of said heat exchanger tubes are secured to the corresponding tube plates, brush driving devices supported by main cleaning device bodies having moving devices are made to confront said opened ends of said heat exchanger tubes, cleaning brushes are moved by pressurized fluid supplied to said brush driving devices s that the inner surfaces of the heat exchanger tubes are cleaned, said device for cleaning inner surfaces of heat exchanger tubes comprising:

a pair of said main cleaning device bodies each having said moving device and said brush driving device and disposed on said tube plates in which said ends of said heat exchanger tubes are respectively opened;

a brush changing device which is provided for at least one of said main cleaning device bodies, said brush changing device being constituted by a brush storing device in which a plurality of portions for storing said cleaning brushes are provided and a changing mechanism;

a driving nozzle, a part of which is inserted into said heat exchanger tube and brush judging means provided for the corresponding brush driving devices respectively which are made to correspond to said opened ends of the same heat exchanger tube, wherein each of said brush driving devices is connected to a pressurized fluid supplying unit having pressurized fluid supplying line, in each of which a control switch valve for moving said cleaning brush by supplying said pressurized fluid is disposed;

a central operation control unit for controlling said two cleaning device bodies;

a position aligning control unit for moving each of said moving devices to a predetermined position, a brush driving control unit for moving said brush driving device by instructing to open/close said control switch valve in the corresponding pressurized fluid supplying lines, and a brush change control unit for controlling said brush changing device in accordance with data obtained by each of said brush judging means, said units, respectively are connected to said central operation control unit, so that signals can be supplied/received.

17. A device for cleaning inner surfaces of heat exchanger tubes according to claim 16, wherein said central operation control unit is provided with a work recording unit.

* * * * *